US005705986A

United States Patent [19]

Zschirnt

[11] Patent Number: 5,705,986

[45] Date of Patent: Jan. 6, 1998

[54] METHOD OF AND APPARATUS FOR AUTOMATIC DEACTIVATION OF ELECTRONIC ARTICLE SURVEILLANCE TAGS

[75] Inventor: Joerg W. Zschirnt, Boca Raton, Fla.

[73] Assignee: Sensormatic Electronic Corporation, Boca Raton, Fla.

[21] Appl. No.: 721,124

[22] Filed: Sep. 26, 1996

[51] Int. Cl.[6] ..... G08B 13/14

[52] U.S. Cl. ..... 340/572; 340/551

[58] Field of Search ..... 340/572, 551

[56] References Cited

U.S. PATENT DOCUMENTS

| | | | |
|---|---|---|---|
| 5,059,951 | 10/1991 | Kaltner | 340/572 |
| 5,210,524 | 5/1993 | Schwarz et al. | 340/551 |
| 5,341,125 | 8/1994 | Plonsky et al. | 340/572 |
| 5,410,296 | 4/1995 | Montbriand et al. | 340/572 |
| 5,500,640 | 3/1996 | Zhou et al. | 340/572 |
| 5,539,394 | 7/1996 | Cato et al. | 340/825.54 |

FOREIGN PATENT DOCUMENTS

| | | | |
|---|---|---|---|
| 0703552A1 | 3/1996 | European Pat. Off. | G08B 13/24 |

*Primary Examiner*—Jeffery A. Hofsass
*Assistant Examiner*—Benjamin C. Lee
*Attorney, Agent, or Firm*—Paul T. Kashimba

[57] ABSTRACT

An apparatus for automatically deactivating an electronic article surveillance tag associated with an article comprising a member for holding a bag for packaging an article having an associated electronic article surveillance tag, deactivation means positioned in relation to the member to deactivate an electronic article surveillance tag associated with an article when such article is in a bag held by the member, and detection means for detecting when a person is in the process of removing a bag from the member to actuate the deactivation means.

23 Claims, 4 Drawing Sheets

METHOD OF AND APPARATUS FOR AUTOMATIC DEACTIVATION OF ELECTRONIC ARTICLE SURVEILLANCE TAGS

FIELD OF THE INVENTION

This invention relates to electronic article surveillance and, more particularly, to deactivating electronic article surveillance tags.

BACKGROUND OF THE INVENTION

Electronic article surveillance (EAS) systems have employed either reusable or disposable EAS tags to monitor articles. The reusable EAS tags are normally removed from the articles before the customer exits the store. The disposable tags are generally attached to the packaging by adhesive or are disposed inside the packaging. These tags remain with the articles and must be deactivated before they are removed from the store by the customer. Deactivation devices generate magnetic or electric fields of sufficient magnitude to render the EAS tag inactive. The deactivated tags are no longer responsive to the incident energy of the EAS system so that an alarm is not triggered.

In one type of deactivation system the checkout clerk passes the articles one at a time over a deactivation device to deactivate the tags and then places the articles into a shopping bag or other bulk container. This system employs one coil disposed horizontally within a housing. The clerk moves the tagged articles across the horizontal top surface of the housing such that the tag is disposed generally coplanar with the coil.

Another deactivation system utilizes a housing having a cavity with three sets of two coils each disposed around the cavity in respective x, y, and z axis planes, such that there is a coil located in a plane parallel to each side of the cavity and two coils disposed around the cavity with one being near the top and the other being near the bottom of the cavity. The checkout clerk pulls a plastic shopping bag from a quantity of plastic shopping bags stored in the cavity on a bulk bag holder with their handles on bag racks. The clerk then places the tagged articles into the bag. After all of the articles have been placed into the bag or when the bag is full, the clerk energizes the coils to deactivate all of the EAS tags in the bag by either stepping on a control switch or pushing a control switch with his hand. The clerk then lifts the bag out of the cavity. This system provides deactivation of multiple tags at one time and does not require specific orientation of the tags.

Many retail establishments having high volume find it desirable to deactivate multiple tags at one time and would like to facilitate this process. It is extremely important that the clerk remember to operate the control switch to actuate the deactivation system to prevent false alarms that could be embarrassing to the customer when he leaves the store with the merchandise. In addition, it can be fatiguing to the clerk to continually step on or push the control switch to actuate the deactivation system.

SUMMARY OF THE INVENTION

In accordance with the present invention there is provided an apparatus for automatically deactivating an electronic article surveillance tag associated with an article comprising a member, deactivation means, and detection means. The member holds a bag for packaging an article having an associated electronic article surveillance tag. The deactivation means is positioned in relation to the member to deactivate an electronic article surveillance tag associated with an article when such article is in a bag held by the member. The detection means detects when a person is in the process of removing a bag from the member to actuate the deactivation means to deactivate the electronic article surveillance tag associated with the article in the bag.

In addition, the present invention provides a method of automatically deactivating an electronic article surveillance tag associated with an article comprising the steps of positioning a deactivation means for deactivating an electronic article surveillance tag in relation to a member for holding a bag such that when the deactivation means is actuated an electronic article surveillance tag associated with an article in a bag held by the member is deactivated, monitoring the member to determine when a person is in the process of removing a bag from the member, and actuating the deactivation means when the monitoring step determines that a person is in the process of removing a bag from the member.

Other objectives, advantages, and applications of the present invention will be made apparent by the following detailed description of the preferred embodiment of the invention.

DETAILED DESCRIPTION OF PREFERRED EMBODIMENTS

Figure 1:
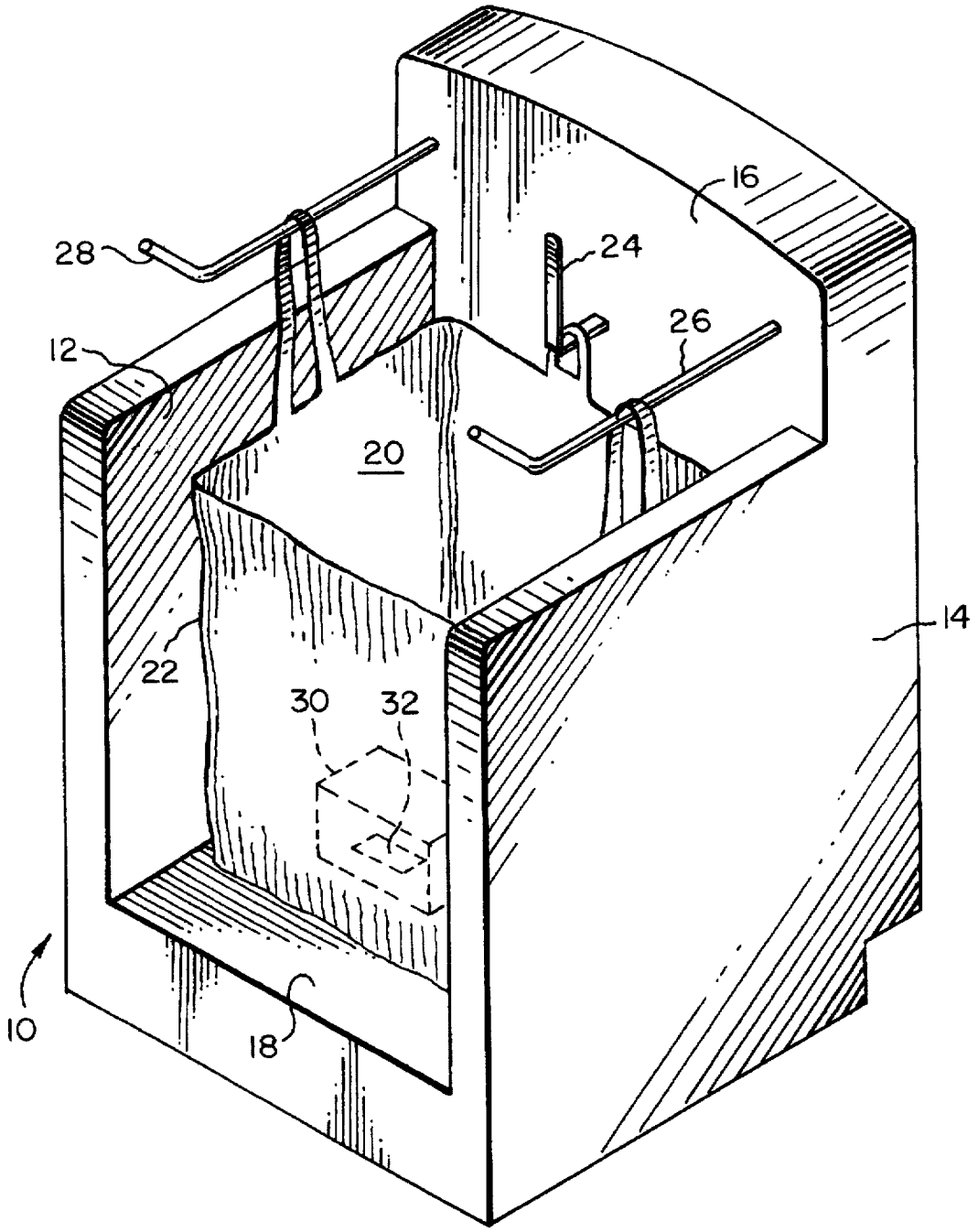
FIG. 1 is a perspective view of a preferred embodiment of a bagging station utilizing the automatic EAS tag deactivation system of the present invention.

Referring to FIG. 1, bagging station 10 has three sidewalls 12, 14, and 16 and a bottom 18 that define a volume 20 in which a shopping bag 22 can be placed. A bulk holder 24 and bag racks 26 and 28 are mounted on sidewall 16. A quantity of plastic shopping bags are normally placed on bulk holder 24 with their handles on bag racks 26 and 28 and then pulled out for use one at a time. Shopping bag 22 contains article 30 which has an associated EAS tag 32 for use with an EAS system as is known in the art. Preferably EAS tag 32 is a magnetoacoustic EAS tag sold by the assignee of this application under the brand name "ULTRA•MAX®", such EAS tags are used widely for then deterrence.

Figure 2:
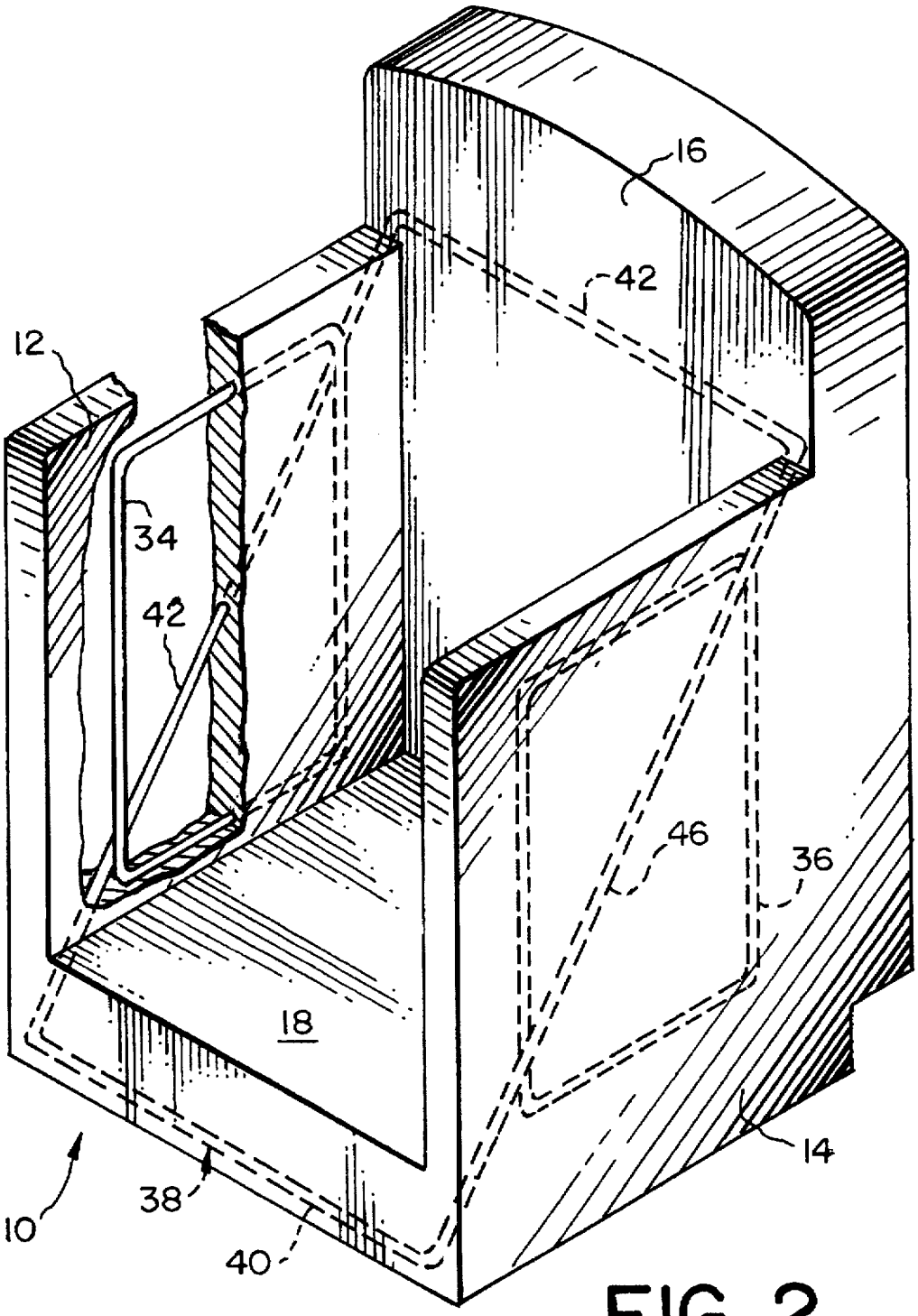
FIG. 2 is a perspective partially cut away view showing a preferred embodiment of the deactivation coils in the bagging station of FIG. 1.

FIG. 2 shows a preferred deactivation coil arrangement in bagging station 10 for use with the present invention. Deactivation coil 34 is located inside sidewall 12, and deactivation coil 36 is located inside sidewall 14. Sidewalls 12 and 14 are parallel so that deactivation coils 34 and 36 are located in parallel planes. Deactivation coil 38 has four coil sections 40, 42, 44, and 46. Coil section 40 is located in the front part of bottom 18, and coil section 42 is located in the top part of sidewall 16. Coil sections 44 and 46 are located in sidewalls 12 and 14 respectively along the approximate respective diagonals of deactivation coils 34 and 36. A power supply, as is shown in FIG. 5, is connected to deactivation coils 34, 36, and 38 to provide them with electrical energy to create the magnetic fields to deactivate EAS tag 32.

Figure 3:
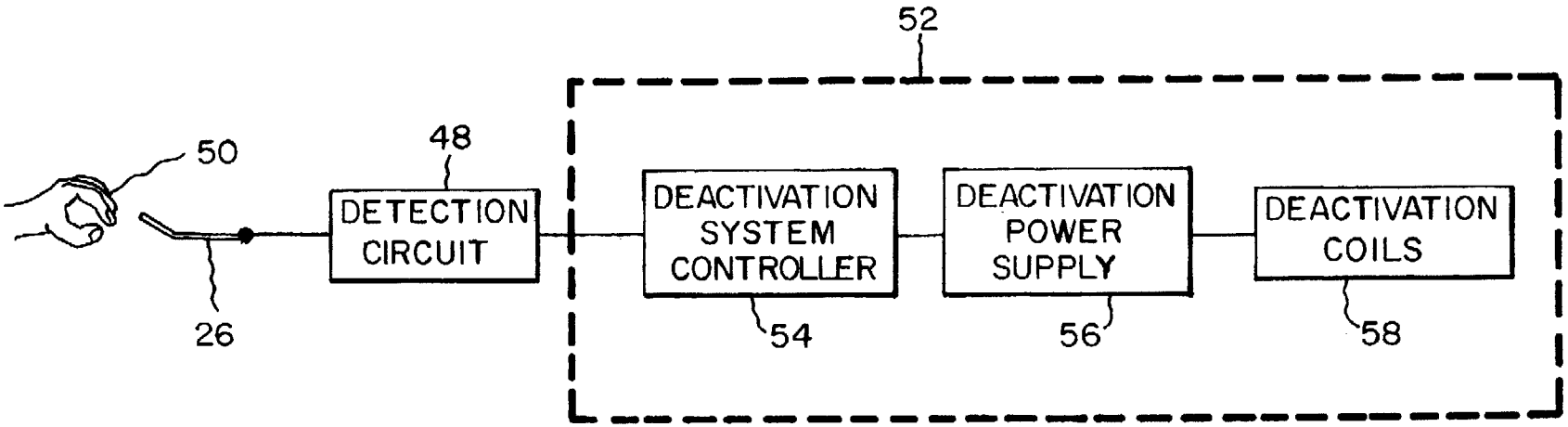
FIG. 3 is a block diagram of the present invention.

Referring to FIG. 3, bagging rack 26, which is a member such as a metal tube or other suitable structure, is connected to detection circuit 48. Bagging rack 26 is electrically insulated from ground potential, e.g., by being mechanically mounted as shown in FIG. 1 on sidewall 16 which is made of a nonconducting material. Detection circuit 48 detects when the checkout clerk is in the process of removing a bag from member 26, which includes the movement of the person's hand toward the bag and member as well as actually removing the bag from the member. Detection circuit 48 detects when a hand (shown by numeral 50) of the checkout clerk is a predetermined distance from bagging rack 26; this predetermined distance from bagging rack 26 includes zero distance or actual contact with bagging rack 26.

Detection circuit 48 is connected to deactivation system 52 which includes deactivation system controller 54, deactivation power supply 56, and deactivation coils 58 (which can be deactivation coils 34, 36, and 38 as show in FIG. 2). When detection circuit 48 detects that hand 50 is within a predetermined distance of bagging rack 26, a signal is provided to deactivation system controller 54. In response to this signal deactivation system controller 54 provides the necessary control signals to deactivation power supply 56 so that power supply 56 energizes deactivation coils 58 to create a field of sufficient strength to deactivate an EAS tag that is in the effective area of deactivation coils 58.

Figure 4:
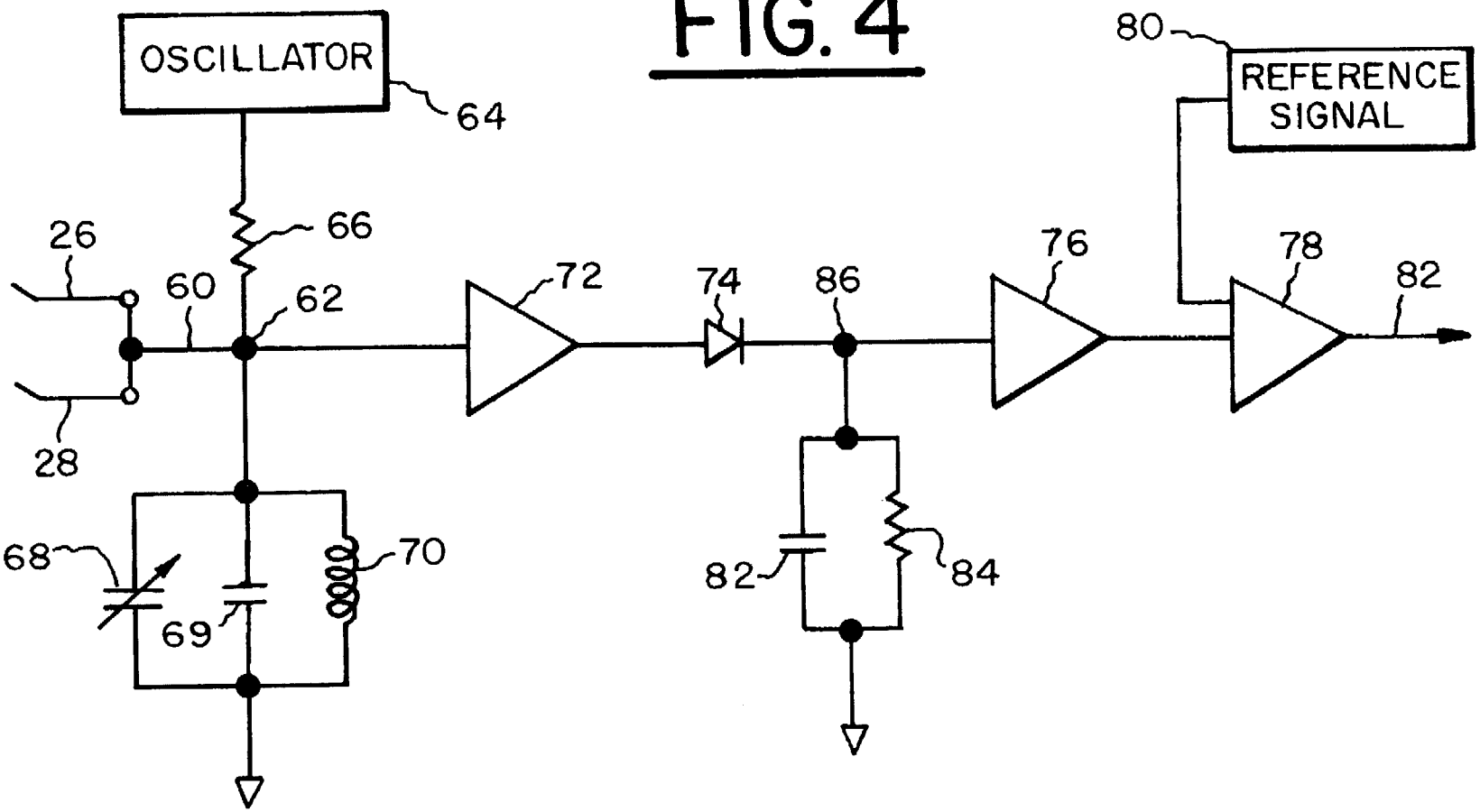
FIG. 4 is a schematic diagram of the preferred embodiment of the present invention.

The preferred embodiment of detection circuit 48 is shown in detail in FIG. 4. Bagging racks 26 and 28 are connected in parallel and are connected by cable 60 to node 62. An oscillator 64, such as part number CD4060 from Harris Semiconductor Corporation with a 3.58 megahertz crystal, is connected through resistor 66 to node 62. A tank circuit consisting of variable capacitor 68 connected in parallel with capacitor 69 and inductor 70 is also connected to node 62. Capacitor 68 has been shown as being variable; however, other means for obtaining the desired frequency could be used, such as a tuneable oscillator or tuneable inductor. The output frequency of oscillator 64 is approximately 224 kilohertz which is the resonant frequency of the tank circuit. In one implementation of the present invention shown in FIG. 4, it has been found that generally the total capacitance of the system is approximately 100 picofarads, resistor 66 should be in the range of one to two megohms, capacitor 68 is variable between 2 to 20 picofarads, capacitor 69 is 39 picofarads, and inductor 70 is approximately 4 millihenries.

The input of amplifier 72 is also connected to node 62. The output of amplifier 72 is connected to diode 74 which in turn is connected to peak detector 76. The peak of the half-wave rectified signal from diode 74 is detected by peak detector 76 and is provided to comparator 78. Reference signal 80 is connected to the other input of comparator 78. A dual operational amplifier, part number LF353, from National Semiconductor Corporation can be utilized for amplifier 72 and peak detector 76, and integrated circuit, part number LM393, from National Semiconductor Corporation can be utilized for comparator 78. Capacitor 82 and resistor 84 are connected in parallel to node 86. Capacitor 82 reduces the ripple in the rectified signal from diode 74. The RC time constant for capacitor 82 and resistor 84 determines the response time of peak detector 76. The response time has to be short enough to cover the situation where the clerk removes the bag quickly from bag racks 26 and 28. Generally, the response time should not be more than 100 milliseconds, and preferably is less than 10 milliseconds. Satisfactory results with the National Semiconductor chips mentioned above have been obtained with capacitor 82 having a value of 0.01 microfarad, and resistor 84 having a value of 100 kilohms.

The magnitude of the signal from peak detector 76 decreases as the clerk's hand or hands approach one or both of bag racks 26 and 28 and changes the capacitance of bag rack 26 and 28. It has been found that a voltage drop of approximately ten percent occurs when a human hand is within approximately 25 millimeters of bag racks 26 and 28. The magnitude of the signal from peak detector 76 decreases significantly, approximately ninety percent, because of conductivity when the clerk touches bag racks 26 and 28. The desired sensitivity of the system is set by choosing the magnitude of reference signal 80. A range of ten to ninety percent voltage drop from the steady state voltage of the system when a human hand is not near bag racks 26 and 28 provides an actuation range of approximately 25 millimeters from bag racks 26 and 28 to contact of bag rack 26 and 28 by the clerk. Comparator 78 provides an actuation signal on output line 82 when the output voltage from peak detector 76 decreases to a voltage that is equal to or less than reference signal 80. In the embodiment using the LM393 semiconductor chip, the output of comparator 78 is TTL compatible and normally provides an output of 5 volts and switches to 0 volts when the reference threshold has been reached. The actuation signal on output line 82 is provided to deactivation system 52 as shown in FIG. 3.

It is to be understood that variations and modifications of the present invention can be made without departing from the scope of the invention. It is also to be understood that the scope of the invention is not to be interpreted as limited to the specific embodiments disclosed herein, but only in accordance with the appended claims when read in light of the foregoing disclosure.

What is claimed is:

1. An apparatus for automatically deactivating an electronic article surveillance tag associated with an article, said apparatus comprising:

(a) a member for holding a bag for packaging an article having an associated electronic article surveillance tag;

(b) deactivation means positioned in relation to said member for deactivating an electronic article surveillance tag associated with an article when the article is in a bag held by said member; and (c) detection means for detecting when a person is in the process of removing a bag from said member to actuate said deactivation means.

2. An apparatus as recited in claim 1, wherein said detection means detects a change in an electrical characteristic of said member.

3. An apparatus as recited in claim 2, wherein said detection means detects a change in an electrical characteristic of said member when a human hand is a predetermined distance from said member.

4. An apparatus as recited in claim 3, wherein said detection means detects a change in the capacitance of said member when a human hand is a predetermined distance from said member.

5. An apparatus as recited in claim 3, wherein said member is electrically insulated from ground potential.

6. An apparatus as recited in claim 3, wherein said detection means detects a change in the impedance of said member when a human hand is a predetermined distance from said member.

7. An apparatus as recited in claim 6, wherein said predetermined distance is zero millimeters.

8. An apparatus as recited in claim 6, wherein said predetermined distance is less than approximately twenty-five millimeters.

9. An apparatus as recited in claim 8, wherein said detection means has a response time of less than approximately one hundred milliseconds.

10. An apparatus as recited in claim 6, wherein said member comprises two members that are electrically connected in parallel to said detection means.

11. An apparatus as recited in claim 10, wherein said members comprise bagging racks.

12. An apparatus as recited in claim 6, wherein said detection means comprises an oscillator and a tank circuit tuned to a predetermined frequency.

13. An apparatus as recited in claim 12, wherein said predetermined frequency is in the range of approximately two hundred to three hundred kilohertz.

14. An apparatus as recited in claim 12, wherein said detection means further comprises a first circuit connected to said member for providing a first signal indicative of the impedance of said member and a comparator connected to said first circuit for comparing said first signal to a predetermined signal and providing an actuation signal to said deactivation means if said first signal is equal to said predetermined signal.

15. An apparatus as recited in claim 14, wherein said detection means further comprises a second circuit that sets the response time of said detection means.

16. An apparatus as recited in claim 15, wherein said first circuit comprises a dual operational amplifier and said second circuit comprises a resistive-capacitive circuit connected to said dual operational amplifier.

17. A method of automatically deactivating an electronic article surveillance tag associated with an article, said method comprising the steps of:

(a) positioning a deactivation means for deactivating an electronic article surveillance tag in relation to a member for holding a bag such that when the deactivation means is actuated an electronic article surveillance tag associated with an article in a bag held by the member is deactivated;

(b) monitoring the member to determine when a person is in the process of removing a bag from the member; and (c) actuating the deactivation means when said monitoring step determines that a person is in the process of removing a bag from the member.

18. A method as recited in claim 17, wherein said monitoring step comprises monitoring an electrical characteristic of the member to determine when a person is in the process of removing a bag from the member.

19. A method as recited in claim 18, wherein said monitoring step comprises determining when a human hand is a predetermined distance from the member.

20. A method as recited in claim 19, wherein said monitoring step comprises detecting a change in an electrical characteristic of the member when a human hand is a predetermined distance from the member.

21. A method as recited in claim 20, wherein said monitoring step comprises detecting a change in the capacitance of the member when a human hand is a predetermined distance from the member.

22. A method as recited in claim 20, wherein said monitoring step comprises detecting a change in the impedance of the member when a human hand is a predetermined distance from the member.

23. A method as recited in claim 22, wherein said monitoring step comprises monitoring the impedance of the member and comparing the impedance with a predetermined signal, and wherein said actuating step comprises providing an actuation signal to the deactivation means when the impedance is equal to the predetermined signal.

* * * * *

UNITED STATES PATENT AND TRADEMARK OFFICE

CERTIFICATE OF CORRECTION

PATENT NO : 5,705,986

DATED : January 6, 1998

INVENTOR(S) : Zschirnt

It is certified that error appears in the above-identified patent and that said Letters Patent is hereby corrected as shown below:

Column 2, line 50, change "them" to --theft--.

Signed and Sealed this

Seventh Day of July, 1998

Bruce Lehman

*Attest:*

BRUCE LEHMAN

*Attesting Officer*

*Commissioner of Patents and Trademarks*